US008330565B2

(12) United States Patent
Eum

(10) Patent No.: US 8,330,565 B2
(45) Date of Patent: Dec. 11, 2012

(54) NOISE DECREASING TYPE ELECTROMAGNETIC SWITCH

(75) Inventor: Young Hwan Eum, Chungbuk (KR)

(73) Assignee: LSIS Co., Ltd., Anyang, Gyeonggi-Do (KR)

( * ) Notice: Subject to any disclaimer, the term of this patent is extended or adjusted under 35 U.S.C. 154(b) by 0 days.

(21) Appl. No.: 13/272,155

(22) Filed: Oct. 12, 2011

(65) Prior Publication Data

US 2012/0092102 A1 Apr. 19, 2012

(30) Foreign Application Priority Data

Oct. 15, 2010 (KR) ..... 10-2010-0100793

(51) Int. Cl.
*H01H 67/02* (2006.01)

(52) U.S. Cl. ..... 335/126; 335/131

(58) Field of Classification Search ..... 335/126, 335/131, 132, 185
See application file for complete search history.

(56) References Cited

U.S. PATENT DOCUMENTS

| | | | | |
|---|---|---|---|---|
| 7,859,373 | B2 * | 12/2010 | Yamamoto et al. | 335/126 |
| 7,876,183 | B2 * | 1/2011 | Uruma et al. | 335/126 |
| 8,138,872 | B2 * | 3/2012 | Yoshihara et al. | 335/281 |
| 2007/0241847 | A1 * | 10/2007 | Yamamoto et al. | 335/196 |
| 2009/0243771 | A1 * | 10/2009 | Uruma et al. | 335/193 |

FOREIGN PATENT DOCUMENTS

| | | |
|---|---|---|
| EP | 0798752 | 10/1997 |
| EP | 1953784 | 8/2008 |

* cited by examiner

*Primary Examiner* — Elvin G Enad
*Assistant Examiner* — Alexander Talpalatski
(74) *Attorney, Agent, or Firm* — Lee, Hong, Degerman, Kang & Waimey

(57) ABSTRACT

A noise decreasing type electromagnetic switch includes a buffer disposed between a stationary core and a contact spring to electrically support a shaft and the stationary core. The buffer includes a buffering space therein. Accordingly, impact caused at the stationary core and the shaft can be effectively absorbed even by the buffering space as well as an elastic force of the buffer. The buffer is inserted in the stationary core for coupling so as to be prevented from being separated during operations, resulting in maintaining long-term durability. Also, the buffer may support the stationary core and a metal plate, whereby an assembly process can be simplified.

14 Claims, 4 Drawing Sheets

NOISE DECREASING TYPE ELECTROMAGNETIC SWITCH

CROSS-REFERENCE TO RELATED APPLICATION

This application claims the benefit of earlier filing date and right of priority to Korean Patent Application No. 10-2010-0100793, filed on Oct. 15, 2010, which is hereby incorporated by reference herein in its entirety.

BACKGROUND OF THE INVENTION

1. Field of the Invention

This specification relates to a noise decreasing type electromagnetic switch capable of noise generated between a stationary core and a movable core.

2. Background of the Invention

In general, an electromagnetic switch is located between a battery and a direct current (DC) power converter of an electric vehicle, such as a hybrid car, a fuel cell car, an electric golf cart, an electric folklift truck and the like, and serves to supply power of the battery to the power converter, and supply power generated from a power generator to the battery.

The electromagnetic switch includes a coil which is excited (magnetized) or demagnetized according to whether or not a control current flows, a yoke installed around the coil to define (form) a magnetic path in the vicinity of the coil, a metal plate installed to face the yoke and defining the magnetic path around the coil together with the yoke, a stationary core fixed to the metal plate, a movable core installed to face the stationary core, and movably installed to contact the stationary core when the coil is excited and to be separated from the stationary core when the coil is demagnetized, a shaft having one end portion coupled to the movable core and movable together with the movable core, and a return spring located between the stationary core and the movable core and having a larger elastic force than contact pressure of a contact spring such that the movable core is separated from the stationary core.

In the structure of the related art electromagnetic switch, when a magnetic field is formed in response to power being applied to the coil, the movable core is attracted toward the stationary core, and an upper conductive portion is run by the shaft connected to the movable core. However, impact noise may be generated while the shaft movable in cooperation with the movable core contacts the stationary core, thereby causing degradation of a perceived quality of a product.

SUMMARY OF THE INVENTION

Therefore, an aspect of the detailed description is to provide a noise decreasing type electromagnetic switch capable of simplifying a coupling process as well as maintaining long-term durability.

To achieve these and other advantages and in accordance with the purpose of this specification, as embodied and broadly described herein, a noise decreasing type electromagnetic switch may include a coil, a yoke installed adjacent to the coil, a metal plate forming a magnetic path adjacent to the coil together with the yoke, a stationary core fixedly installed at the metal plate, a movable core contactable with the stationary core when the coil is excited, a return spring disposed between the movable core and the stationary core to apply an elastic force such that the movable core is separated from the stationary core, a shaft connected to the movable core to be movable together with the movable core, a movable contact point coupled to the shaft to be movable together with the shaft, a stationary contact point fixed to face the movable contact point and contactable with or separated from the movable contact point such that an electric circuit is closed or open, and a contact spring configured to elastically support the movable contact point to contact the stationary contact point, wherein a buffer is disposed between the stationary core and the contact spring to elastically support the shaft and the stationary core.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Figure 1:
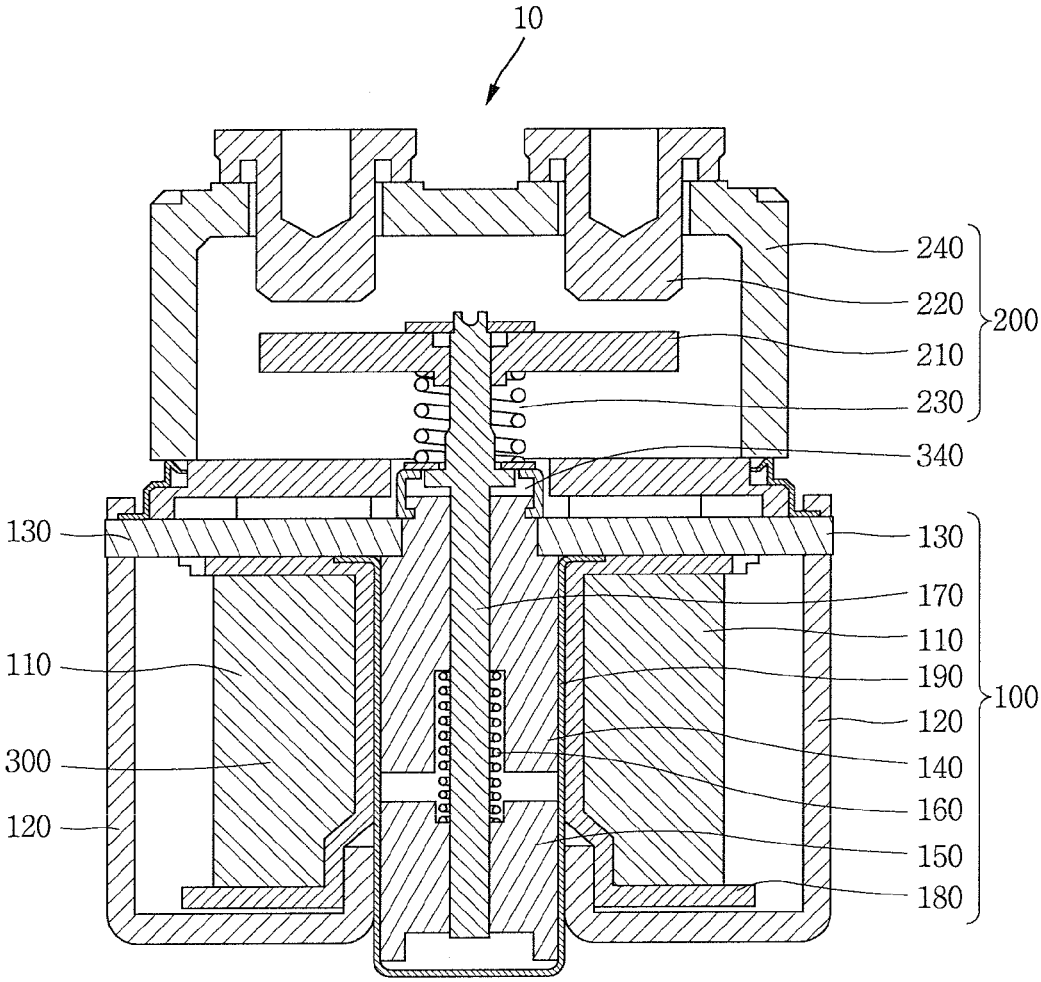
FIG. 1 is a sectional view showing an open state of a noise decreasing type electromagnetic switch in accordance with one exemplary embodiment.
Figure 2:
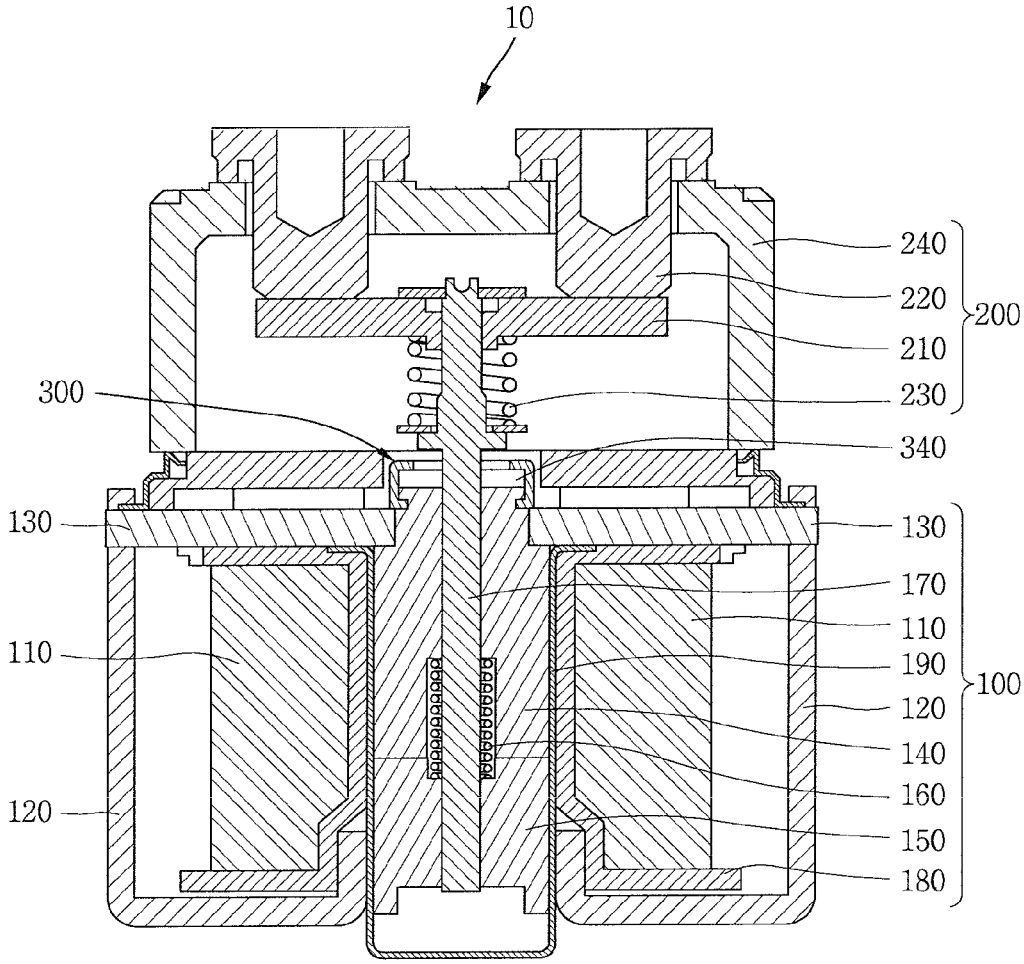
FIG. 2 is a sectional view showing a closed state of the noise decreasing type switch.
Figure 3:
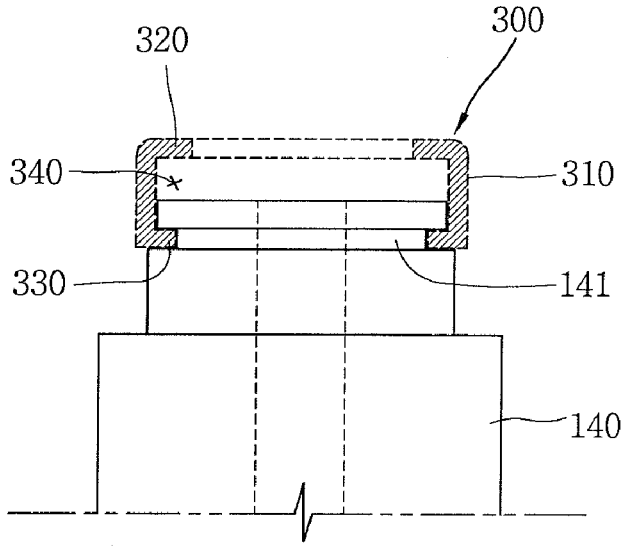
FIG. 3 is a side view showing a stationary core in accordance with the one exemplary embodiment.
Figure 4:
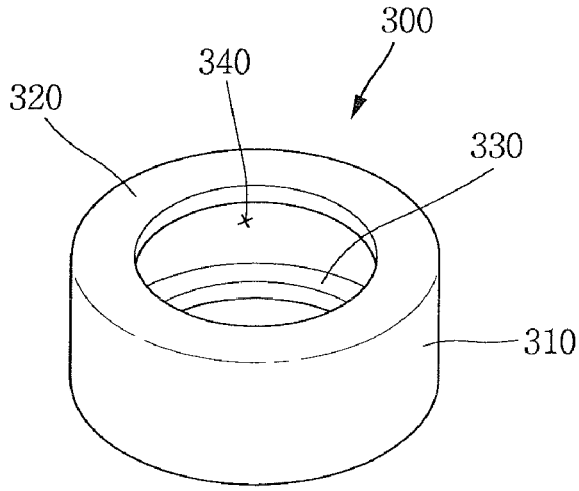
FIG. 4 is a perspective view showing a buffer in accordance with the one exemplary embodiment.
Figure 5:
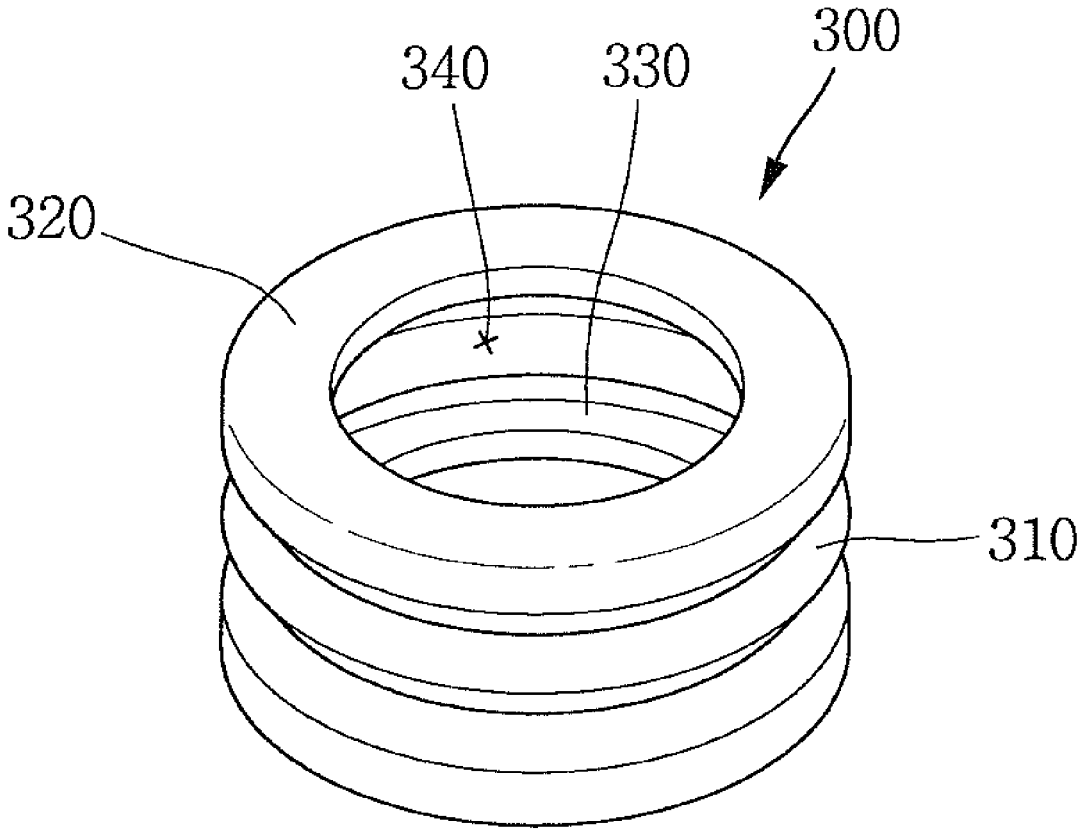
FIG. 5 is a perspective view showing a buffer in accordance with another exemplary embodiment.

FIG. 1 is a sectional view showing an open state of a noise decreasing type electromagnetic switch in accordance with one exemplary embodiment, FIG. 2 is a sectional view showing a closed state of the noise decreasing type switch, FIG. 3 is a side view showing a stationary core in accordance with the one exemplary embodiment, and FIG. 4 is a perspective view showing a buffer in accordance with the one exemplary embodiment.

As shown in FIGS. 1 and 2, a noise decreasing type electromagnetic switch 10 may include a driving unit 100, and a conducting unit 200 switched on or off with respect to the exterior with moving up and down by the driving unit 100. The conducting unit 200 may have a contact-point switching structure, which includes a stationary contact point 220 and a movable contact point 210, so as to allow switching with respect to an external device connected to the electromagnetic switch 10.

The driving unit 100 may control contact or non-contact between the contact points using an electric signal. The driving unit may include a coil 110 for generating driving forces of the contact points by a magnetic force generated by the electric signal, a yoke 120 installed adjacent to the coil 110 to form a magnetic path adjacent to the coil 110, a metal plate 130 forming a magnetic path adjacent to the coil 110 together with the yoke 120, a stationary core 140 fixed within the coil 110, and a movable core 150 disposed to face the stationary core 140.

A coil bobbin 180, on which the coil 110 is wound, may be located between the coil 110 and the stationary core 140 and the movable core 150. The stationary core 140 and the movable core 150 may be disposed in a longitudinal direction based on an axial direction of the coil bobbin 180. The stationary core 140 and the movable core 150 may form a magnetic path, through which magnetic flux generated by the coil 110 flows. The magnetic flux generated by the coil 110 may make the movable core 150 moved up and down.

A core case 190 may be located between the coil bobbin 180 and the stationary and movable cores 140 and 150. The core case 190 may be formed of a non-magnetic material and be in a cylindrical shape having an opening at a surface facing the conducting unit 200 and a bottom of an opposite surface blocked. That is, the core case 190 may have a shape like a case for accommodation of the stationary core 140 and the movable core 150 therein, and be formed in a cylindrical shape with an inner diameter, which is approximately the same as the outer diameter of each of the stationary core 140 and the movable core 150. The movable core 150 may be movable in an axial direction of the core case 190.

The movable core 150 may be movable in the range between a position of being contactable with the stationary core 140 and an initial position where the movable core 150 is separated from the bottom of the opposite surface of the core case 190. The movable core 150 may be contactable with the stationary core 140 by a contact spring 230 to be explained later and return to its original position by a return spring 160 to be explained later.

A through hole may be formed through central portions of the stationary core 140 and the movable core 150 in an axial direction. A shaft 170 may be inserted through the through hole so as to connect the driving unit 100 and the conducting unit 200 to each other. The shaft 170 may be coupled with the movable contact point 210 at its upper end and the movable core 150 at its lower end so as to transfer a longitudinal motion of the movable core 150 to the movable contact point 210.

A cover 240 may be coupled to the driving unit 100 by being loaded on the driving unit 100. The cover 240 may be box-shaped with an open lower side. Terminal holes (reference numeral not given) for insertion of the stationary contact point 220 and a fixing terminal therein may be formed at an upper portion of the cover 240.

The movable contact point 210 coupled to the shaft 170 below the stationary contact point 220 may be disposed within the cover 240. A space for performing contact and separation between the stationary contact point 220 and the movable contact point 210 for a switching operation may be present between the stationary contact point 220 and the movable contact point 210 within the cover 240.

The contact spring 230 may be disposed at a lower side of the movable contact point 210. The contact spring 230 may have an elastic force when the movable contact point 210 contacts the stationary contact point 220. The contact spring 230 may allow the movable contact point 210 to remain in the contact state with the stationary contact point 220 by pressure more than a preset level. Also, when the movable contact point 210 is separated from the stationary contact point 220, the contact spring 230 may reduce a movement speed of each movable core 150 and shaft 170. Consequently, when the movable core 150 contacts the core case 190, an impact may be relieved to minimize or prevent generation of noise and vibration.

The movable contact point 210, which is movable in response to movement of the shaft 170, may be coupled to another end of the shaft 170, and the stationary contact point 220 may be fixed above the movable contact point 210 to face the movable contact point 210. As the stationary contact point 220 contacts or is separated from the movable contact point 210, an electric circuit is closed or open.

The contact spring 230 for providing an elastic force to the movable contact point 210 to contact the stationary contact point 220 may be installed at the lower side of the movable contact point 210 at the periphery of the shaft 170.

With the configuration of the electromagnetic switch 10, when a magnetic field is formed in response to power being applied to the coil 110, the movable core 150 is attracted toward the stationary core 140, the upper conducting unit 200 is run by the shaft 170 connected to the movable core 150. Here, the movable core 150 contacts the stationary core 140, thereby generating impact noise, which may lower a perceived quality of a product.

To address such problem, a buffer, which is in an annular shape having sawlike threads attached thereon, may be mounted between the stationary core and the shaft to decrease vibration and noise generated between the shaft and the stationary core. However, the sawlike buffer may probably experience an impact fatigue cumulative damage in view of its structural characteristic. Furthermore, as the buffer is simply mounted at the stationary core, upon repetitive operations, it may be separated from its initial position and sandwiched between other structures.

Therefore, this exemplary embodiment aims to implementing a structure that a bowl-shaped buffer is coupled to a recess of the stationary core, has a buffering space therein, and supports the stationary core and the metal plate.

To this end, a fixing recess 141, which is recessed (concaved) inwardly, may be formed at an upper portion of the stationary core 140 along a periphery thereof. A fixing step 330 of a buffer 300 to be explained later may be inserted in the fixing recess 141.

The fixing recess 141 may preferably be formed such that the fixing step 330 to be explained later can be inserted therein so as to support the metal plate 130.

The buffer 300 may include a side wall portion 310 defining a cylindrical shape, an supporting portion 320 curved inwardly to support an upper end of the side wall portion 310, namely, the contact spring 230, and a fixing step 330 curved inwardly from a lower end of the side wall portion 310.

The side wall portion 310 may be formed in form of a smooth pipe. Alternatively, the side wall portion 310 may be formed in form of a bellows.

The side wall portion 310 may be higher than a distance or gap between the fixing recess 141 and an upper surface of the stationary core 140 so as to define a specific buffering space 340 between an inner side surface of the side wall portion 310 and the stationary core 140.

When the inwardly recessed stationary recess 141 is formed at the upper side surface of the stationary core 140, the fixing step 330 of the buffer 300 may be inserted in the fixing recess 141 of the stationary core 140 to prevent the separation of the buffer 300 upon driving the shaft 170.

In accordance with the noise decreasing type electromagnetic switch, the buffering space is formed within the buffer so as to absorb impact due to air staying in the buffering space, in addition to an elastic force of the buffer. Also, the buffer may be coupled to the recess of the stationary core to be prevented from being separated, thereby maintaining long-term durability. The buffer may support the stationary core and the metal plate, thereby simplifying an assembly process.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A noise decreasing type electromagnetic switch comprising:

a coil;

a yoke installed adjacent to the coil;

a metal plate configured to form a magnetic path adjacent to the coil together with the yoke;

a stationary core fixedly installed at the metal plate;

a movable core configured to contact the stationary core when the coil is excited;

a return spring located between the movable core and the stationary core and configured to apply an elastic force such that the movable core is separated from the stationary core;

a shaft connected to the movable core and configured to move together with the movable core;

a movable contact point coupled to the shaft and configured to move together with the shaft;

a stationary contact point facing the movable contact point and configured to contact or separate from the movable contact point in order to close or open an electric circuit;

a contact spring configured to elastically support the movable contact-point;

a buffer located between the stationary core and the contact spring and configured to elastically support the shaft and the stationary core;

a fixing recess formed at an outer circumferential surface of the stationary core; and a fixing step formed at one end of the buffer and configured to be inserted into the fixing recess.

2. The switch of claim 1, wherein the buffer comprises:

a side wall portion formed in a cylindrical shape and having the fixing step formed at one end; and a supporting portion curved inwardly from a second end of the side wall portion and configured to support the contact spring.

3. The switch of claim 2, wherein the supporting portion is formed such that an inner side surface of the supporting member is higher than an upper surface of the stationary core.

4. The switch of claim 2, wherein the side wall portion has a form of a smooth pipe.

5. The switch of claim 2, wherein the side wall portion has a form of a bellows.

6. The switch of claim 1, wherein the fixing recess is formed flush with an upper surface of the metal plate or adjacent to the contact spring rather than the metal plate.

7. The switch of claim 6, wherein the fixing step is longer than a depth of the fixing recess.

8. A noise decreasing type electromagnetic switch comprising:

a coil;

a yoke installed adjacent to the coil;

a metal plate defining a magnetic path adjacent to the coil together with the yoke;

a stationary core fixedly installed at the metal plate;

a movable core configured to contact the stationary core when the coil is excited;

a return spring located between the movable core and the stationary core and configured to apply an elastic force such that the movable core is separated from the stationary core;

a shaft connected to the movable core and configured to move together with the movable core;

a movable contact point coupled to the shaft and configured to move together with the shaft;

a stationary contact point facing the movable contact point and configured to contact or separate from the movable contact point in order to close or open an electric circuit;

a contact spring configured to elastically support the movable contact point to contact the stationary contact point;

a buffer located between the stationary core and the contact spring, the buffer comprising a buffering space between the stationary core and the shaft and configured to elastically support the shaft and the stationary core, a fixing recess formed at an outer circumferential surface of the stationary core; and a fixing step formed at one end of the buffer and configured to be inserted into the fixing recess.

9. The switch of claim 8, wherein the buffer further comprises:

a side wall portion formed in a cylindrical shape and having the fixing step formed at one end; and an upper wall curved inwardly from a second end of the side wall portion and configured to support the contact spring.

10. The switch of claim 9, wherein the upper wall is formed such that an inner side surface of the upper wall is higher than an upper surface of the stationary core.

11. The switch of claim 9, wherein the side wall portion has a form of a smooth pipe.

12. The switch of claim 9, wherein the side wall portion has a form of a bellows.

13. The switch of claim 8, wherein the fixing recess is formed flush with an upper surface of the metal plate or adjacent to the contact spring rather than the metal plate.

14. The switch of claim 13, wherein the fixing step is longer than a depth of the fixing recess.

* * * * *